US005992068A

United States Patent [19]

de Saro

[11] Patent Number: 5,992,068

[45] Date of Patent: Nov. 30, 1999

[54] SIGN FOR ILLUMINATION UTILIZING TRANSLUCENT LAYERS

[75] Inventor: Javier Alejandro Garcia de Saro, Los Dolores, Spain

[73] Assignee: James H. Chisholm, Milwaukee, Wis.

[21] Appl. No.: 09/048,688

[22] Filed: Mar. 26, 1998

[51] Int. Cl.[6] ..... G09F 13/04

[52] U.S. Cl. ..... 40/564; 40/577; 40/615

[58] Field of Search ..... 40/564, 577, 575, 40/576, 595, 568, 615, 427; 362/812

[56] References Cited

U.S. PATENT DOCUMENTS

| | | | |
|---|---|---|---|
| 276,558 | 5/1883 | Brown, Jr. . | |
| 478,204 | 7/1892 | McGimsey . | |
| 1,786,155 | 12/1930 | Farrell . | |
| 1,805,798 | 5/1931 | Bedrossyan . | |
| 1,887,523 | 11/1932 | Schenkel . | |
| 1,975,690 | 10/1934 | Harrington et al. . | |
| 1,998,857 | 4/1935 | Wolff . | |
| 2,058,058 | 10/1936 | Caccia . | |
| 2,071,239 | 2/1937 | Spencer et al. . | |
| 2,107,860 | 2/1938 | Gilbert . | |
| 2,155,936 | 4/1939 | Fuller | 40/577 X |
| 2,211,571 | 8/1940 | Jonap . | |
| 2,213,868 | 9/1940 | Lucian . | |
| 2,262,930 | 11/1941 | Gasper . | |
| 2,285,907 | 6/1942 | Davis | 40/577 |
| 2,374,323 | 4/1945 | Bihr . | |
| 2,594,903 | 4/1952 | Freedman et al. . | |
| 2,689,917 | 9/1954 | Switzer . | |
| 2,707,346 | 5/1955 | Fuller, Jr. . | |
| 2,810,225 | 10/1957 | Hardesty . | |
| 3,131,496 | 5/1964 | Schropp | 40/564 X |
| 3,163,554 | 12/1964 | Gessler | 40/564 X |
| 3,270,201 | 8/1966 | Hardesty . | |
| 3,771,245 | 11/1973 | Mabrey et al. . | |
| 3,978,599 | 9/1976 | Berger . | |
| 4,106,859 | 8/1978 | Doriguzzi et al. . | |
| 4,424,449 | 1/1984 | O'Brill . | |
| 4,507,888 | 4/1985 | Robinson et al. . | |
| 4,583,766 | 4/1986 | Wessel . | |
| 4,648,189 | 3/1987 | Michel . | |
| 4,891,896 | 1/1990 | Boren . | |
| 4,953,067 | 8/1990 | Moore . | |
| 4,967,317 | 10/1990 | Plumly . | |
| 5,009,019 | 4/1991 | Erlendsson et al. . | |
| 5,237,766 | 8/1993 | Mikolay . | |
| 5,414,947 | 5/1995 | Hjaltason . | |
| 5,444,932 | 8/1995 | Jeroma . | |
| 5,536,558 | 7/1996 | Shelton . | |
| 5,682,697 | 11/1997 | Hjaltason . | |

FOREIGN PATENT DOCUMENTS

| | | |
|---|---|---|
| 414216 | 8/1934 | United Kingdom . |
| 496482 | 11/1938 | United Kingdom . |

OTHER PUBLICATIONS

Product Bulletin "Reflexite" Reflective Material, Reflexite Corporation, Nov. 1987, 2 pages.

Guide Specification "Reflexite" Reflective Material, Reflective Corporation, May 1990, 1 page.

*Primary Examiner*—Brian K. Green

*Assistant Examiner*—James M Hewitt

*Attorney, Agent, or Firm*—Andrus, Sceales, Starke & Sawall

[57] ABSTRACT

A sign has multiple light translucent layers that are adjacent one another with such translucent layers being broken to form in one or more areas indicia (i.e. letters, numbers, etc.) meant to be visualized by an observer. These areas include a mid-layer, which is preferably colored and may be florescent, and a forefront layer. A large transparent void area is located between the mid-layer and the forefront layer, the forefront layer being closest to the observer. The forefront layer has a base color layer, which may be slightly reflective, and an outer color layer which is closest to the viewer. The base color layer and the outer color layer, like the mid-layer, are in the shape of letters and indicia to be communicated. At least one milky white background layer forms the back of the sign. Other milky white layers having breaks in their integrity may be located adjacent to the rear most milky white layer and resulting in a soft background design.

7 Claims, 4 Drawing Sheets brite
brite
brite

SIGN FOR ILLUMINATION UTILIZING TRANSLUCENT LAYERS

BACKGROUND OF THE INVENTION

This invention relates to an illuminated sign having multiple translucent layers which give depth, texture and three-dimensional effects to the sign. This novel technology is based upon the utilization of multiple translucent layers which results in varying levels of brightness once the sign is illuminated. The sign as a whole is vibrant and there is no need to either darken or shadow portions of the sign in order to highlight or give the illusion that other portions are "brighter". This results in a very pure color quality and a sign which, on the whole, is brighter and has greater light intensity. Further, these multiple layers of translucency not only determine the light intensity but also the apparent depth of the letters, indicia, communications, etc. on the sign.

Companies are constantly searching for more effective ways to advertise their products. Portions of advertisement signs such as trademarks or trade names are typically meant to be viewed first and thus create a greater impact to a potential purchaser. Other portions of the sign, such as background indicia, are meant to be more subtle. In the past, advertisers used large letter size or specialized font to attract a buyer's attention to more important areas of the sign and thus "prioritize" certain areas of the sign. The advantage of this invention is that it is able to use brightness and depth as a prioritization agent, as opposed to letter size or font. The brightness, depth and texture created by this novel sign enables the eye of the observer to prioritize information allowing the eye to read what is brightest, most striking and at the forefront of the sign rather than what is in largest print.

Not only does the prior art utilize elaborate fonts and increased physical size of the letters (or indicia) to communicate to the observer what is most important, but it also utilizes actual three dimensional signs to physically place certain communications closer to the viewer. Specifically, in order to create three-dimensional appearances, varied textures and different degrees of brightness, the prior art teaches that the sign itself must be physically three-dimensional with depressed portions and raised portions, as shown in U.S. Pat. No. 2,594,903. Conversely, the present invention utilizes a series of two-dimensional translucent layers tiered one layer over another layer in order to create a three-dimensional effect.

The essence of this new technology is using multiple translucent layers and building upon these layers so that when combined, they give an illusion of texture and dimension. These different layers of translucency give the benefit of texture in an otherwise flat, two-dimensional environment. Specifically, the mere use of multiple translucent layers creates a sign which, in its entirety, is bright and also has areas of greater intensity and attraction to the observer. The novel sign is also easier to produce than the aforementioned prior art due to the simple layering of various translucent layers in order to create a 3-D effect without physically elevating or depressing different portions of the sign. In other words, there is no need for any protrusions in relief form in order to create added dimensions. As a result, the present invention does not require complex manufacturing processes to physically raise and depress different areas of the sign which have high production costs.

Still other prior art teaches darkening or shading less important areas of a sign in order to create emphasis. Specifically, U.S. Pat. Nos. 5,414,947 ('947) and 5,009,019 ('019) utilize opaque layers on the rear of the sign plate in order to prioritize information to the observer. Specifically, the '947 and the '019 patents utilize opaque layers to create differing levels of intensity by blocking out light in areas of the sign not meant to communicate information or in areas of less important communications.

However, a major disadvantage with utilizing an opaque layer in an illuminated sign is that the sign in general becomes dull or dark and the colors become dim or mutated. For example, a color such as white actually appears to be gray and bright yellows become mustard toned. Conversely, utilizing multiple light translucent layers enables the sign in its entirety to be bright, yet have different dimensions, textures and light intensities depending on the number of translucent layers and their spatial relation to one another and the observer.

This novel invention provides a completely different effect than would be experienced were an opaque layer provided as claimed and taught by the prior art.

This invention also enhances visibility to the viewer by utilizing a halo effect around letters or indicia to be communicated. This halo effect is caused by light passing through multiple translucent layers of the sign and reflecting off of the rear face of a front layer, which comprises, for example, letters meant to be communicated to the viewer. The light subsequently reflects off of a foremost portion of a back layer, which is in the general shape of the front letter, then forward and outward around the edges of the front letter onward to the viewer. This creates a halo around that letter.

An outline effect is also created by light simply passing directly through the multiple translucent back layers and around the edges of a translucent front layer defining the letters, then passing directly onto the viewer.

Another benefit to this invention is the use of a solid milky white layer present across the entire rear face of the sign. This milky white layer not only diffuses light passing through it, increasing sign intensity and brightness, but also adds to the illusion of texture by not allowing the observer to see "through" the sign.

Another advantage to the use of a rear solid milky white layer is that several milky white layers may be placed adjacent the rear layer with the additional layer(s) having some element of design, meant to act as background in the sign for an added textured effect.

BRIEF SUMMARY OF THE INVENTION

This novel sign is comprised of multiple light translucent layers, tiered adjacent one over the next, with the very last layer furthest from the observer, being a translucent milky white diffusion layer. The letters or indicia of the sign to be communicated to the observer may be "cut-out" of one or more of the translucent layers. In other words, the integrity of the translucent layer(s) may be broken. Conversely, the letters may be printed directly on one of the translucent layers located near the front of the sign.

The multiple translucent layers primarily create the main background color(s) of the sign. The areas which define the letters preferably have a different color than that of the multiple translucent layers to provide contrast between the communication and the background.

There further exists a "void layer" between the multiple translucent layers, which create the background color of the sign, and a forefront layer(s) which is closest to the observer.

The void layer is preferably a completely clear, transparent layer. The greater the width of this void, the more pronounced the depth of the sign and the greater the three-dimensional effect.

The forefront layer is in the shape of the letters or indicia to be communicated to the observer. If a dimensional effect is desired, the letters are in general registered with the aforementioned letters printed or cut-out of the translucent layer(s) immediately adjacent the void layer. The forefront layer consists of a base color layer and an outer color layer. The base color layer is directly adjacent the void layer and is preferably slightly reflective and can also be colored or florescent.

The outer color layer directly adjacent the base color layer is on the very forefront of the sign and is closest to the observer. This outer color layer is translucent, preferably colored and/or florescent. This layer constitutes the main color of the letter or indicia to be communicated.

The sign also has a translucent milky white diffusion layer on the very rear of the sign. Additional milky white layers may be added to the sign if an added background effect is desired. This additional layer or layers should be between the rear solid milky white layer and the very last light translucent layer. The integrity of this additional milky white layer will be broken in areas in order to create a pattern or design.

All of the aforementioned create a sign with halo and outline effect, striking light intensities, brightness, three dimensional effect and texture.

DETAILED DESCRIPTION OF THE INVENTION

This novel sign is comprised of multiple light translucent layers, tiered adjacent to the next layer with the very last layer furthest from the observer being a milky white diffusion layer. The sign further consists of a forefront layer which defines the letters or indicia to be communicated. This forefront layer consists of an outer color layer and a base color layer. There also exists a void layer in between the forefront layer and the rear multiple translucent layers.

Figure 1:
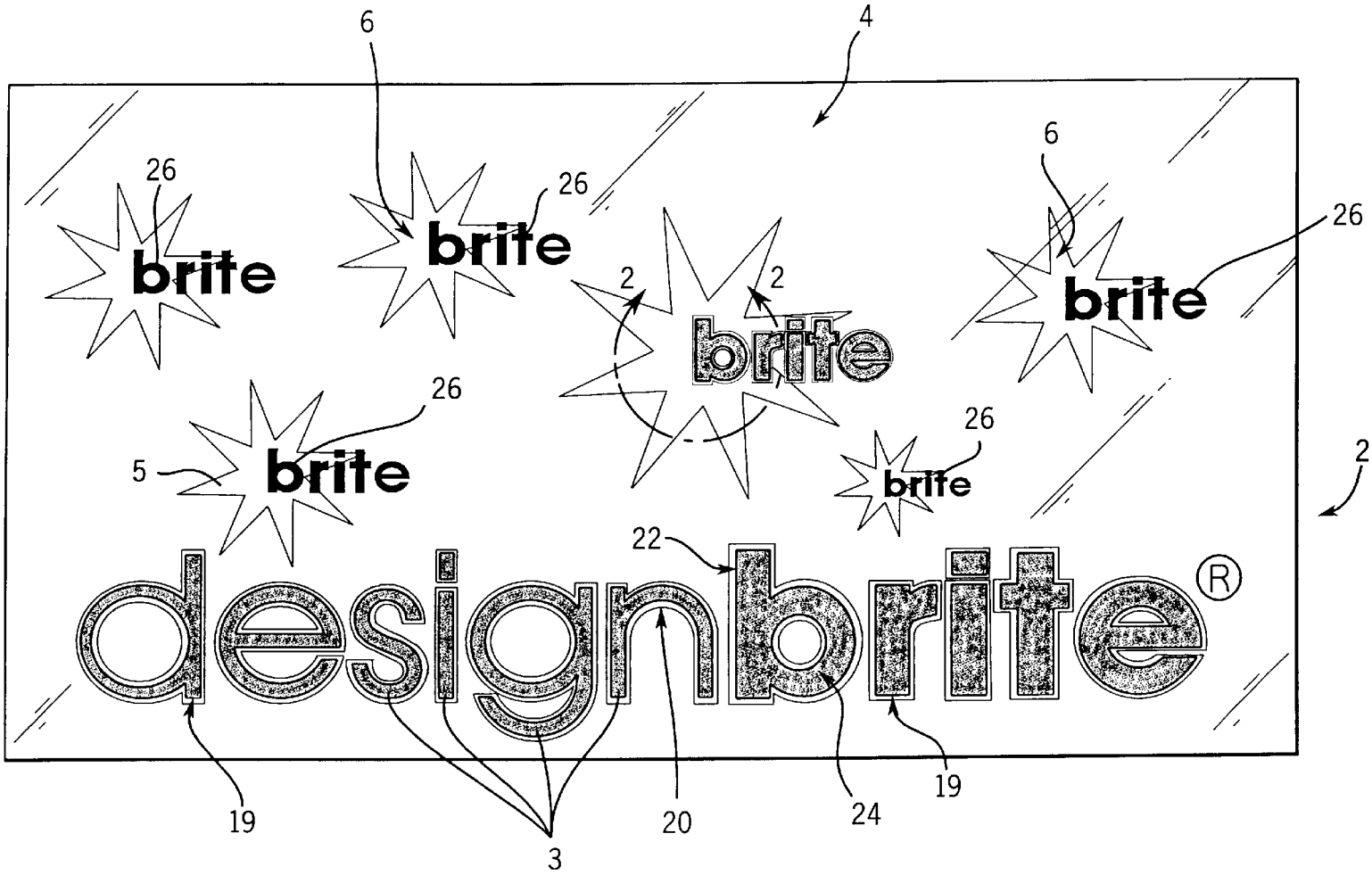
FIG. 1 is a front elevated view of the invention.

As seen in FIG. 1, the sign 2 has letters 3 or indicia on its front surface which are in general register so that they are substantially centered over corresponding indicias or mid-layer 19 on one of the foremost light translucent layer surfaces 16, providing a three-dimensional effect. The color of this corresponding indicia on the light translucent mid-layer 19 will be the color of the halo around each letter once illuminated.

Figure 3:
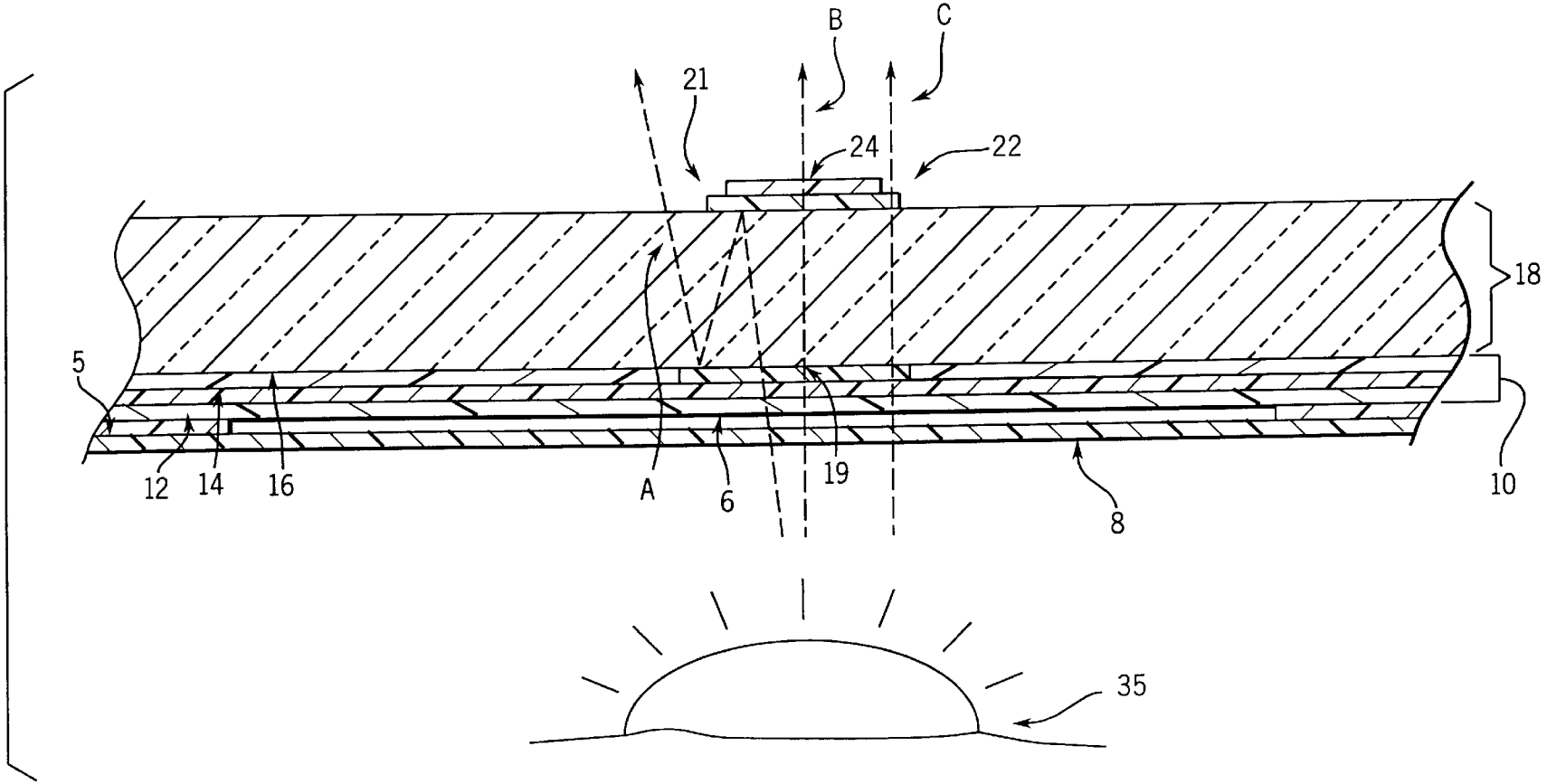
FIG. 3 is a cross-sectional view of the invention taken along lines 3—3 of FIG. 2.

The area defining the letters, 3 meant to be communicated to the observer, may be layered or printed directly on top of a large, completely transparent layer called a "void layer" 18, as shown in FIG. 3. This void area 18 aids in producing dimensional effects to the sign. The letters, conversely, may interrupt the integrity of void layer 18 itself rather than be printed directly on top of this layer.

Figure 2:
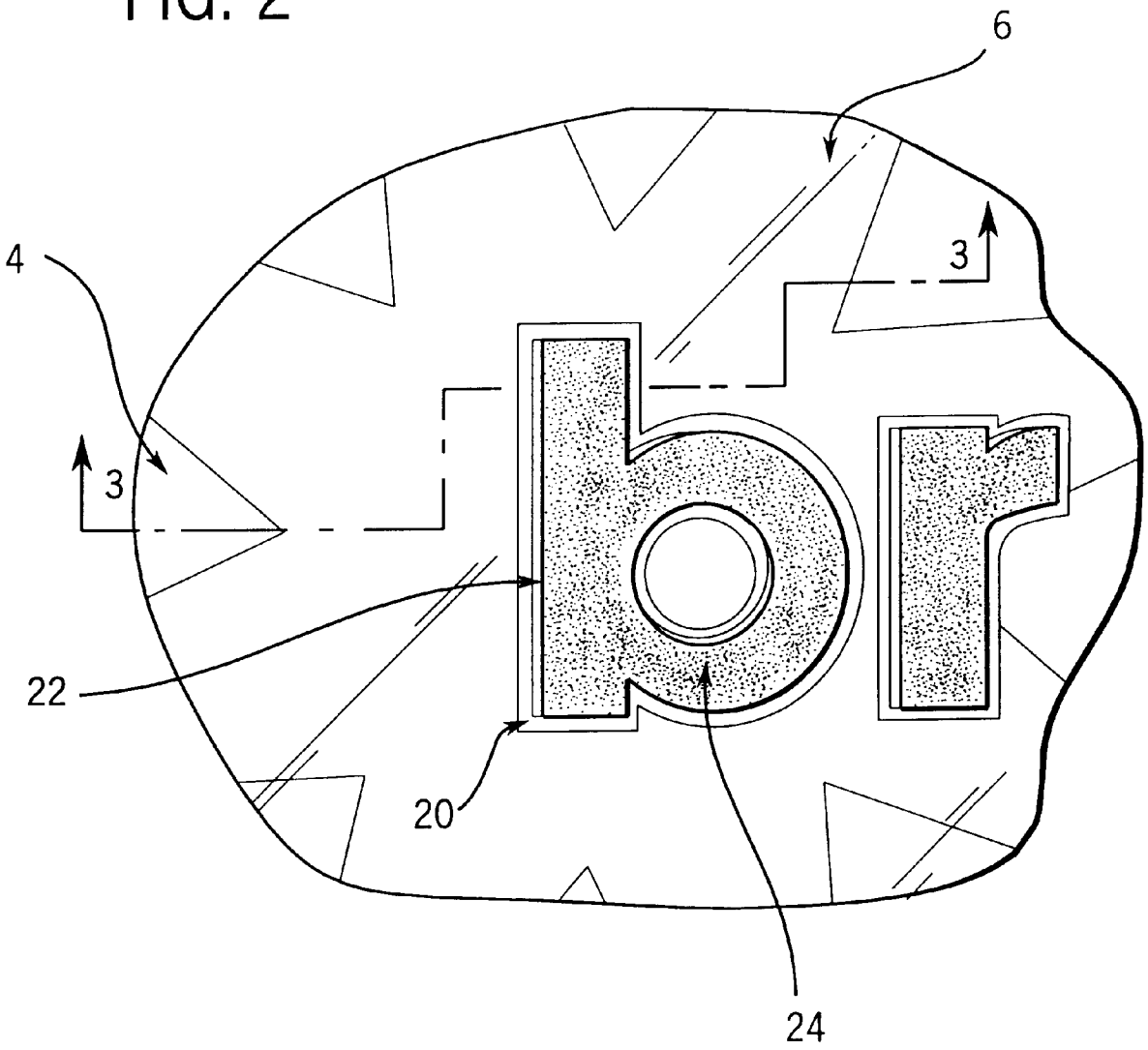
FIG. 2 is an enlarged view of a section 2—2 of the invention shown in FIG. 1.

As shown in FIGS. 2 and 3, the forefront layer 21 consists of two layers, one being the outer color layer 24, which is translucent and is the basic color of the letters or indicia to be communicated. Underneath this outer color layer 24, and immediately adjacent the void layer 18, is a base color layer 22, having a back surface which is slightly reflective. It is also preferable that this base color layer 22 be white. This layer creates a slight white outline of the indicia or letters to be communicated, especially when viewed at a slight angle.

The intermediate area or void area 18 is between the forefront layer 21, defining the letters and including the outer color layer 24 and base color layer 22, and the rear multiple translucent layers 10. This void area 18 is preferably completely transparent and the greater the width of the void area 18, the greater the dimensional effect.

The entire background color 4 of the sign is determined by the color of the multiple light translucent layers 10. The intensity or brightness of the sign itself is determined by the actual number and vividness of light translucent layers 10. FIG. 3 illustrates the multiple translucent layers 10 consisting of a first translucent layer 12, a second translucent layer 14 and a third translucent layer 16.

A mid-layer 19 coincides with the shape of the letters or indicia to be communicated if dimensional, outline and halo effects are desired. This mid-layer 19 is colored and may even be florescent and it corresponds with the forefront layer 21, i.e. the area comprising the letters, indicia, etc. This mid-layer 19 may break the integrity, or be inserted in the plane of the forefront light translucent layer 16 or it may be printed onto this light translucent layer 16.

The rearward most layer of sign 2 consists of a solid milky white light diffusion layer 8. There may be more than one milky white light diffusion layer if it is intended that a background design be created, best seen as the stars in FIG. 1. The design is created by gaps 6 in the integrity of the additional milky white layer 5, as shown in FIGS. 2 and 3.

If depth, outline and halo effects are not intended for certain indicia, then those indicia may be directly printed onto any of the rear multiple light translucent layers, 12, 14 and 16. Another way to create this effect is to only have mid-layer indicia 19 and not have a corresponding indicia on the forefront layer 21 such as seen in FIG. 1, denoted by 26 and spelling "BRITE". This would be intended for communications which are not meant to be a high priority, but are meant for added effect or secondary communication as these letters or indicia appear quite distant from the viewer.

An outline effect also aids in creating a physical three-dimensional view. The outline effect is created by sizing the letters or indicia on the forefront layer 21 slightly smaller than the rear letters or indicia of the mid-layer 19. The outline effect is also highlighted by the base color layer 22 which creates a slight outline of the letters, especially when the sign is viewed from an angle.

If creation of a background design utilizing the milky white diffusion back layers is desired, an additional milky white layer 5 is located adjacent the completely solid milky while layer 8 which comprises the entire rear-most surface of the sign. The additional milky while layer 5 has breaks or gaps 6 in the form of the desired design, interrupting its integrity. These interruptions create the design 6 itself once the sign is illuminated. Thus, where breaks 6 exist in the additional (i.e. closest to the viewer) milky white translucent layer 5, light passes through with a brighter intensity as opposed to the areas where there is no design and light must pass through two milky white translucent layers 5 and 8.

Figure 4:
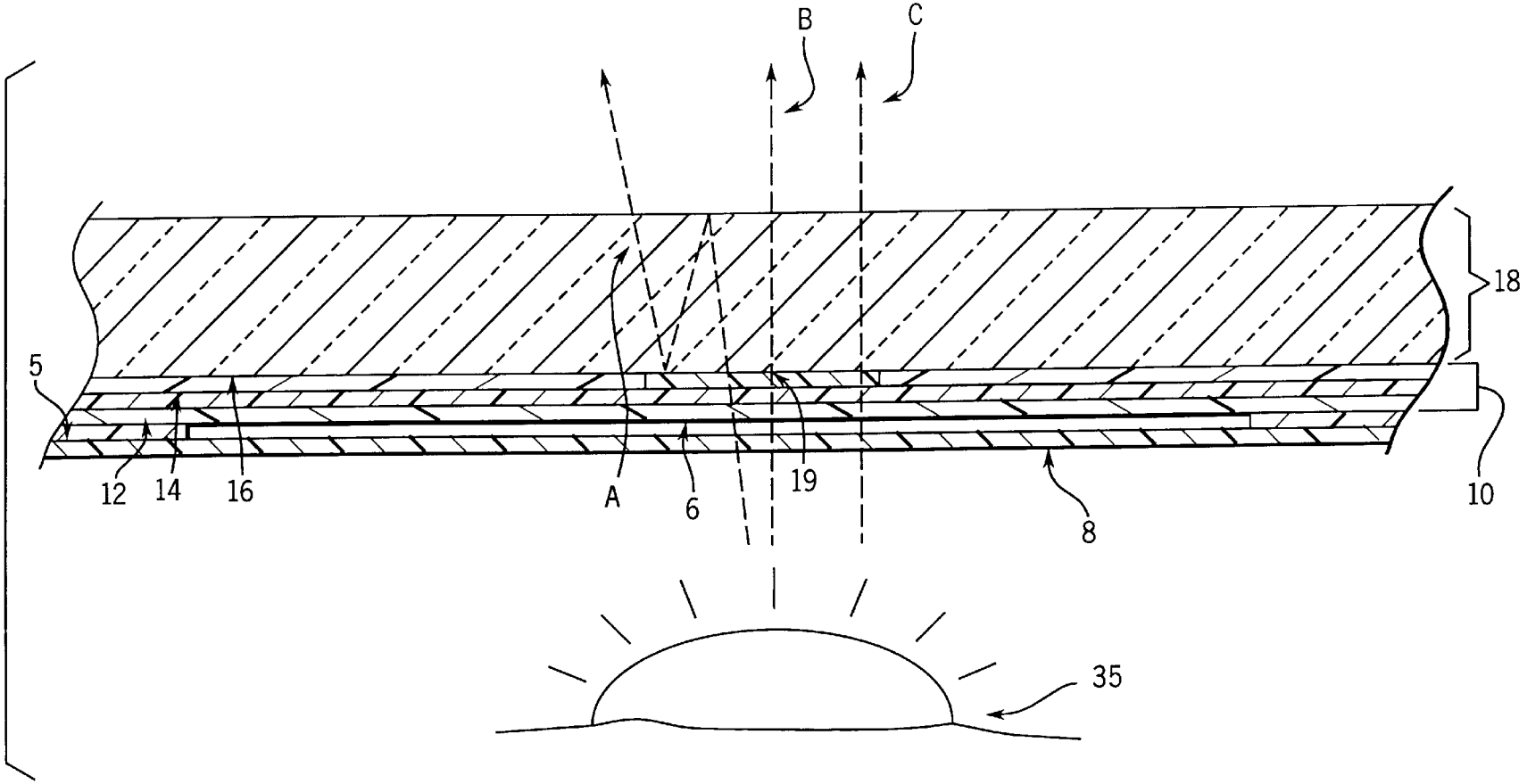
FIG. 4 is a cross-sectional view taken along lines 4—4 of FIG. 1.

An optional feature of this invention involves communications meant to be of intermediate importance—i.e. not the most important communication on the sign but not the least important. These communications involve a complete lack of a forefront layer 21, as shown in FIG. 4. Light is transmitted directly through the milky white layers 5 and 8 through the multiple translucent layers 12, 14 and 16, and subsequently through void layer 18, as shown by light path Z. Other light rays additionally pass through mid-layer 19 as shown by Y and Y'. The rays Y' diffuse and create a soft halo effect around mid-layer 19. It is important to note that there is a complete lack of forefront layer 21. Due to the absence of a forefront layer 21, the light rays are not reflected and thus the halo effect is softer. If forefront layer is present, as shown in FIG. 3, the halo effect is stronger due to the contrast of forefront layer 21 with the rest of the sign.

In operation, light from the light source 35 is diffused by the rear-most milky white light diffusion layer 8. From there, light travels through multiple translucent layers 10. When light passes through a communication (i.e. letters, indicia, etc.), it passes through a translucent mid-layer 19, which is preferably fluorescent or colored, then it passes through a transparent void layer 18. Next, the light then may be reflected backward off of the base color layer 22, which is slightly reflective, and which may have color and/or florescence to it, but is preferably white. If the rays are reflected off the base color layer 22, they pass back through the void layer 18 and strike the mid-layer 19 (which is in general register with the forefront layer 21), then pass out forward at an angle just past the letters (i.e. forefront layer 21) on toward the viewer, shown by light path A. This creates the halo or glowing effect. Conversely, some light passes through this base color layer 22, which is translucent, and then travels directly through the outer color layer 24 onto the viewer, shown by light path B.

The design allows, some slight to pass directly through the milky white diffusion layer 8 through the multiple translucent layers 10, which consist of a first light translucent layer 12, a second light translucent layer 14 and a third light translucent layer 16, through the mid-layer 19, through the void 18 and onward just past the edges of the base color layer 22 and outer color layer 24 (i.e. the forefront layer 21), directly to the viewer to create somewhat of a hazy outline effect, shown by light path C.

The color of mid-layer 19 is the color of this hazy outline, with the mid-layer 19 preferably being slightly wider than the forefront layer 21. Also, creating an outline effect is the reflection or transmission of light through the base color layer 22, preferably creating a slight white edging or outline of the letters, indicia, etc., especially when the sign is viewed from an angle. The outline created by the base layer is quite sharp and helps in defining the letters.

Further, light can be transmitted directly through the milky white light diffusion layer 8, through the multiple layers of light translucent layers 10, which may or may not be colored, depending on the design of the sign, directly through the void layer 18 and onward to the viewer. Light which follows this path constitutes the main background color of the sign 4, as opposed to communicating the letters or indicia.

In the case where a faint background design 6 is desired, light is transmitted through the first milky white diffusion layer 8 and an additional milky white diffusion layer 5 and onward toward to the viewer. Where there is a break 6 in the integrity of the additional milky white diffusion layer 5, the light only passes through the first milky white diffusion layer 8 and onward toward the viewer which creates the background pattern or design forged in the additional milky white diffusion layer 5. Where there is no break in the additional milky white diffusion layer 5, light must travel through both layers, resulting in slightly less intensity.

Since light is being transmitted through the sign in its entirety due to the complete lack of any opaque layers, the sign itself is of great intensity and vibrant color.

I claim:

1. An illuminated sign having multiple translucent layers and having visual indicia to be communicated to a viewer, comprising:

a first translucent milky white light diffusion layer defining a back of a sign plate;

at least two light translucent layers located adjacent a rear-translucent milky white light diffusion layer;

a translucent mid-layer adjacent a forewardmost light translucent layer which is in a shape of the indicia to be communicated to a viewer of the sign;

a void layer which is adjacent to said mid-layer and is completely transparent; and at least one forefront layer adjacent said void layer which corresponds and is substantially centered over said mid-layer, said forefront layer comprises a translucent base color-ply and a translucent outer color-ply; said outer color-ply being the outermost ply with respect to the void layer and said base color-ply being adjacent to said void layer, and wherein said base color-ply and said outer color-ply are in the shape of the indicia to be communicated to the viewer.

2. The invention of claim 1 wherein there exists a second light translucent milky white light diffusion layer located between said first milky white light diffusion layer and a rearmost light translucent layer of the two light translucent layers.

3. The invention of claim 1 wherein said mid-layer is colored.

4. The invention of claim 1 wherein said translucent base color ply is colored.

5. The invention of claim 4 wherein said translucent base-layer is white.

6. The invention of claim 1 wherein said forefront layer has a cross-section smaller than a cross-section of said mid-layer.

7. An illuminated sign having multiple translucent layers and having visual indicia to be communicated to a viewer, comprising:

a first translucent milky white diffusion layer defining a back of a sign plate;

at least two light translucent layers located adjacent a rear translucent milky white light diffusion layer;

at least one translucent mid-layer adjacent a forward-most light translucent layer which is in a shape of indicia to be communicated to the viewer of the sign; and a void layer which is adjacent to said mid-layer and is completely transparent.

* * * * *